United States Patent [19]

Castiglia

[11] 4,108,149

[45] Aug. 22, 1978

[54] MATERNITY BRACE

[76] Inventor: Ignatius F. Castiglia, 500 E. 77th St., New York, N.Y. 10021

[21] Appl. No.: 757,153

[22] Filed: Jan. 6, 1977

[51] Int. Cl.[2] ..... A41C 1/08

[52] U.S. Cl. ..... 128/579 R

[58] Field of Search ..... 128/579, 573, 574, 558, 128/553, 559, 78

[56] References Cited

U.S. PATENT DOCUMENTS

| | | | |
|---|---|---|---|
| 3,434,469 | 3/1969 | Swift | 128/78 |
| 3,888,245 | 6/1975 | Brentson | 128/78 |
| 4,022,197 | 5/1977 | Castiglia | 128/78 |

FOREIGN PATENT DOCUMENTS

| | | | |
|---|---|---|---|
| 200,042 | 12/1938 | Switzerland | 128/573 |
| 1,292,165 | 3/1962 | France | 128/78 |
| 2,334,500 | 1/1975 | Fed. Rep. of Germany | 128/78 |

*Primary Examiner*—Doris L. Troutman

*Attorney, Agent, or Firm*—Flynn & Frishauf

[57] ABSTRACT

A fully adjustable maternity brace which includes an elastic portion carrying a heat-deformable, substantially rigid, back support member, and a removable front panel which is adjustably connected to the ends of the elastic member, the front panel being adapted to lie against the abdominal portion of a pregnant woman. Preferably, the front panel is contoured to the general shape of the abdomen of a pregnant woman.

12 Claims, 11 Drawing Figures

MATERNITY BRACE

This invention relates to an appliance suited for use by pregnant women to provide back support.

It is the main object of the present invention to provide an appliance for pregnant women which provides back support to the woman and which is fully and easily adjustable to accommodate and support the growing abdomen of a pregnant woman without requiring replacement or substantial alteration to the appliance.

It is a further object of the invention to provide such an appliance with a back support which is easily deformable, for example under heat, to precisely conform to the back contours of the wearer and which becomes substantially rigid, in its formed state, upon cooling.

SUMMARY OF THE INVENTION

In accordance with the present invention, an appliance for pregnant women comprises an elastic belt-like section adapted to extend across a rear body portion of a wearer, generally in the vicinity of the waist of a wearer, the elastic section having respective free end portions; means forming a pocket in the elastic section; and a substantially rigid sheet-like member received in the pocket for engagement against a predetermined portion of the body of a wearer in the vicinity of the lower back of the wearer. Further provided is a completely separable front panel having opposing end portions; and means for adjustably connecting both of the opposing end portions of the front panel to the respective free end portions of the elastic section at a plurality of positions relative to the free end portions so that the front panel is substantially symmetrically locatable relative to the elastic section with the front panel overlying an abdominal portion of the body of a wearer and so that the appliance is adjustable to accommodate growth of the abdominal area of a pregnant woman.

In an alternative arrangement, a pocket need not be formed in the rear section of the belt-like member. The substantially rigid sheet-like member may be attached directly to the belt-like member by other means.

DETAILED DESCRIPTION

Figure 1:
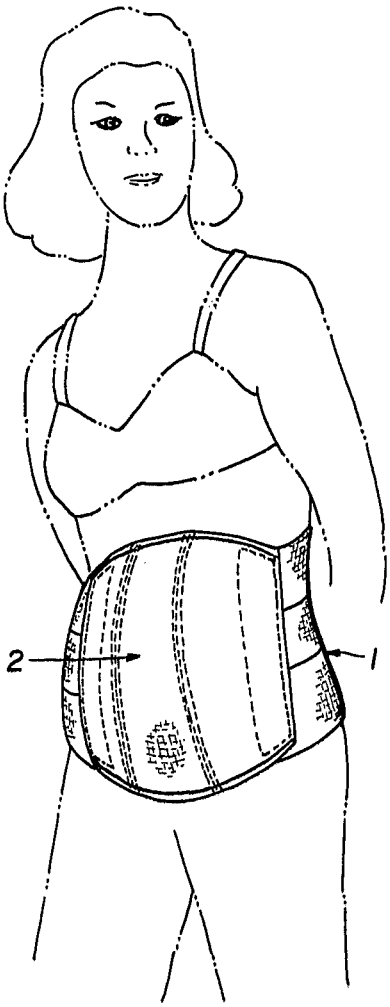
FIG. 1 is a front perspective view of the maternity brace of the present invention in position on the body of a wearer.
Figure 2:
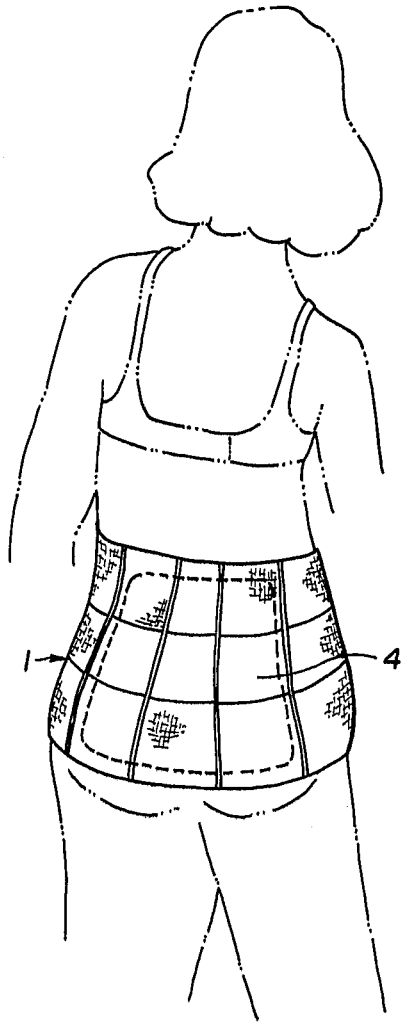
FIG. 2 is a rear perspective view of the device of FIG. 1, in use.

Referring to FIGS. 1 and 2, a maternity brace of the present invention is shown on a pregnant woman. The appliance generally comprises an elastic belt member generally designated by the reference numeral 1 which encompasses the rear and side portions of the wearer, and a front panel 2 which is removably secured at both ends thereof to the elastic belt member 1. As better shown in FIG. 3, the belt member 1 has a pocket 3 therein for removably receiving a substantially rigid member 4 of heat deformable material. The elastic belt member 1 is located on the body of the wearer so that the substantially rigid member 4 is located adjacent the back of the wearer so as to provide support.

Figures 4, 5, 6, 7, 8, 9, 10A, 10B:
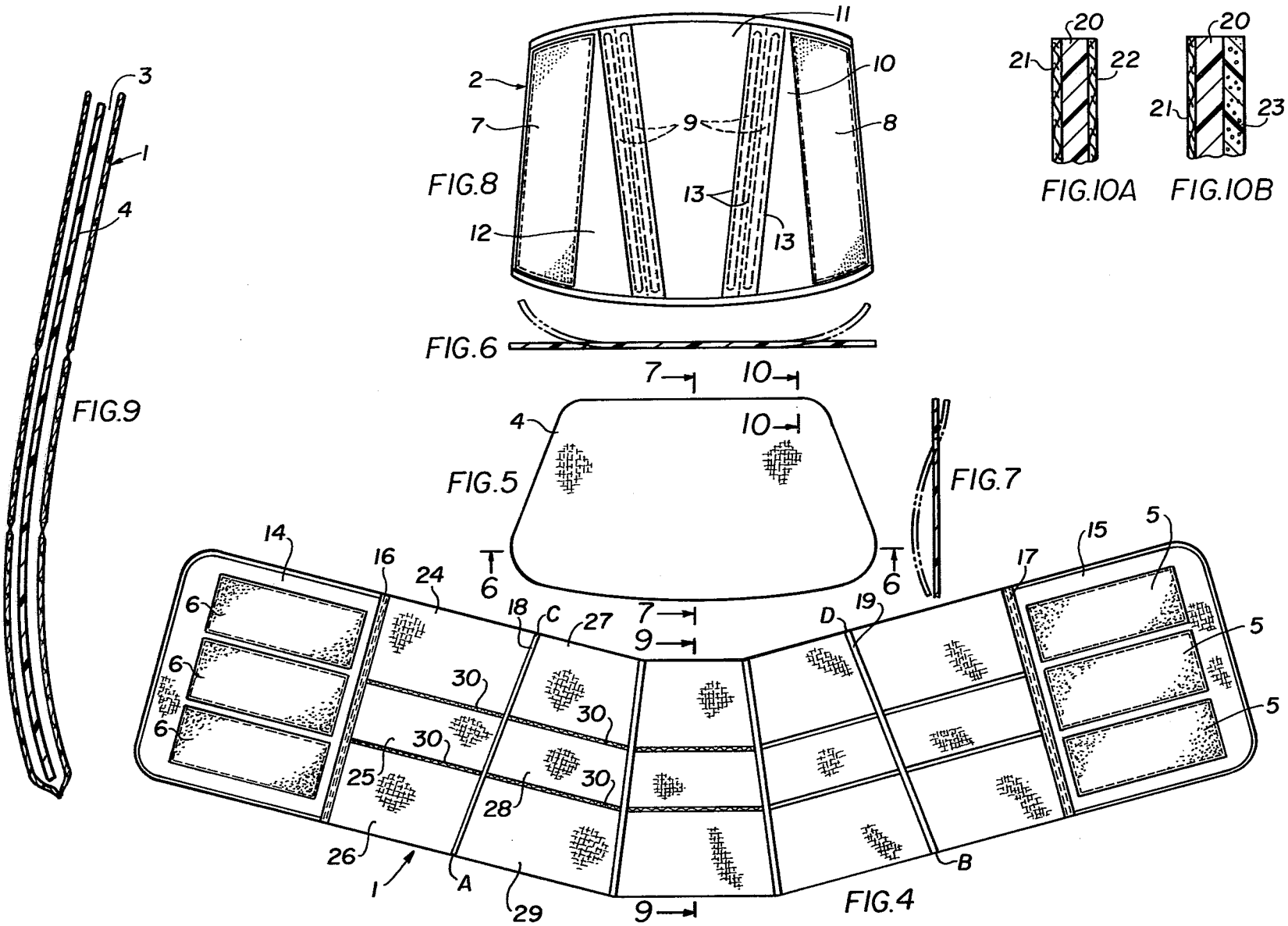
FIG. 4 is a flat view of the device of the present invention looking from the outer surface.
FIG. 5 illustrates a typical, molded back support panel for use in the present invention.
FIG. 6 is a cross-sectional view of the panel of FIG. 5, the panel being shown in its flat state in solid lines and contoured state in phantom lines.
FIG. 7 is a side cross-sectional view of the panel of FIG. 5, the panel being shown in its flat state in solid lines and its contoured state in phantom lines.
FIG. 8 is a view, from the inside, of the removable abdomen panel.
FIG. 9 is a cross-sectional view of the device taken along the line 9—9 of FIG. 4, shown with the contoured panel in position in a pocket.
FIGS. 10A and B are enlarged partial cross-sectional views of respective typical moldable members for use as the back support section of the present invention.

The front portions of the belt 1 have fasteners, such as Velcro fasteners 5, 6 for securing the front panel 2 to the belt 1. Other fasteners such as hooks, or the like, can be used to provide secure but adjustable fastening of the front panel 2 to the belt 1. As best seen in FIG. 8, the front panel 2 has Velcro fastening members 7, 8 which removably attach to the Velcro members 5, 6 of the belt 1. As should be apparent, the Velcro fasteners 7, 8 are relatively wide as are the Velcro fasteners 5, 6 so that the front panel 2 may be secured to the belt member 1 at a plurality of positions to accommodate for growth of the abdomen of a pregnant woman as pregnancy proceeds. This enables the size of the device to be readily expanded, while also providing proper back support and proper abdomen support. The size of the device can be adjusted in a symmetrical manner so that the various support members are always properly oriented relative to the body of the wearer.

The front panel 2 further includes substantially rigid elongated stays 9 for preventing buckling of the front panel 2 and for providing additional support to the wearer. The stays 9 may be secured to the front panel by means of stitching, adhesives, or may be located in respective pockets stitched to the removable panel 2 (as in FIG. 8).

Figure 3:
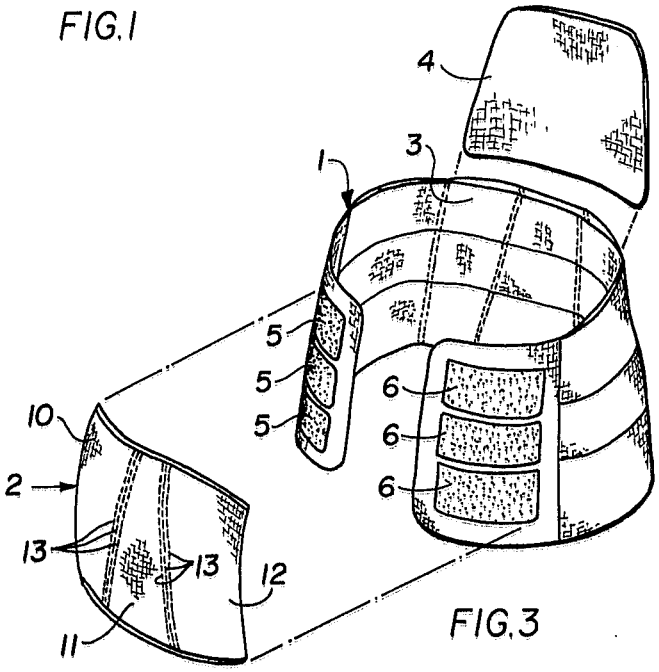
FIG. 3 is an exploded perspective view of the device of FIGS. 1 and 2 showing the relative positions of the three major components thereof, with the back support member removed from its pocket.

The front panel 2 is preferably made of a substantially rigid non-elastic fabric, and is preferably formed so as to have an outwardly curved contour, as shown in FIG. 3. The contour may be readily obtained by fabricating the front panel 2 from three separate pieces of material 10, 11, 12 stitched together, for example by seams 13. Pockets may be formed by seams 13 in which the stays 9 are received. The outward contour of the front panel 2 provides better conformance with the contour of the abdomen of a pregnant woman and enhances the performance of the appliance of the present invention.

As best seen in FIGS. 4 and 9, the belt 1 has a pocket 3 (see FIG. 9) formed therein for receiving the substantially rigid, heat-deformable member 4. The bottom closed portion of the pocket 3 extends between points A and B as shown in FIG. 4. The open top portion of the pocket 3 extends between points C and D as shown in FIG. 4. The belt 1 is preferably fabricated completely of elastic material, except for the inelastic end portions 14 and 15, which are secured to the elastic main portion, for example by respective seams 16 and 17. The pocket 3 may be defined by seams 18 and 19 formed in either a continuous piece of elastic material, or formed when connecting individual pieces of elastic material together, for example as shown in FIG. 4. The seams connecting individual pieces of elastic material together for the portions of the belt which overlie the pocket are formed in only the respective opposing pieces, so as to form a hollow pocket 3 for receiving the member 4. The belt is, in its flat state, generally slightly "V-shaped," so as to provide a better fit around the waist area of a pregnant woman. An overlay of fabric or elastic may be secured to the belt, for example by stitching, to cover the seams between the various belt portions. If desired, stays, or the like, could be located in the vicinity of the various seams 16–19.

The substantially rigid member 4 which is removably inserted into the pocket 3 is preferably of a plastic heat-deformable material such as, for example, the plastic sheet material alone or covered as disclosed in U.S. Pat. No. 3,906,943, the entire contents of which are incorporated herein by reference. The insert 4 is heat formed to conform to the body portion of the wearer against which it is to be adjacent as disclosed in said U.S. Pat. No. 3,906,943. Other suitable materials can also be used to form the removable member 4. FIGS. 6 and 7 show typical examples of how a heat-deformable member 4 is formed to conform to a body portion, such as the back of a wearer.

In FIGS. 10A and 10B, there are shown typical material configurations from which the heat-deformable member 4 may be fabricated. The heat-deformable members 4 are preferably of a plastic heat-deformable material 20 with fabric layers 21, 22 on opposite sides thereof as disclosed in said U.S. Pat. No. 3,906,943. One of the fabric layers 21, 22, which are securely adhered to the plastic layer 14, is preferably of an insulating material to prevent heat from the heated up insert from being uncomfortably transmitted to the body of the wearer when the insert is being formed to conform to the body contour of the wearer.

As shown in FIG. 10B, the plastic material 14 may be provided with a foam layer 23 to replace one of the fabric layers. In use, the foam layer 23 is directed toward the body of the wearer to provide additional cushioning to provide impact absorption characteristics to the device and to generally make the device more comfortable in normal use. The foam layer 23 also acts as the insulating layer when conforming the heated up member 4 to the body contours of the wearer. A foam-covered plastic member is disclosed, for example, in U.S. Pat. No. 2,800,129.

By virtue of the pocket 3 being generally trapezoidal in shape (as shown in FIGS. 2, 3 and 4), the removable member 4 is securely retained in the belt 1. In order to insert the member 4 in the pocket 3, it is only necessary to stretch the elastic material of the belt so as to spread apart points C and D (FIG. 4) to permit the member 4 to enter into the pocket 3. When the belt is relaxed, the points C and D move again toward each other to positively retain the member 4 in place.

The belt 1 is preferably made of a plurality of elastic panels, such as panels 24–29 (FIG. 4) which are sewn together to form the composite elastic belt structure. The generally horizontal seams 30 are preferably loose seams which permit limited relative movement between adjacent panels 24–25, 25–26, etc. The generally vertically oriented seams are preferably tight seams which do not permit such relative movement. While the portion of the belt 1 between seams 16 and 17 is shown as being completely elastic, alterations could be made by interposing sections of inelastic material. However, such an alternative construction would be less advantageous than the construction illustrated in the figures. While the substantially rigid member 4 is shown as being removably retained in its pocket 3, it may be permanently mounted therein. Moreover, the precise shape of the heat-deformable member 4 may be varied, as suits the particular requirements.

Various other modifications and alterations could be made, as will be apparent to those skilled in the art, within the spirit and scope of the accompanying claims.

I claim:

1. An appliance for pregnant women, comprising:

a substantially elastic belt-like section having respective free end portions, said elastic section being adapted to extend across a rear body portion of a wearer, and to extend from an upper level in the vicinity of the upper part of the abdomen to a lower level in the vicinity of the lower part of the abdomen of a wearer;

a substantially rigid sheet-like member carried by said substantially elastic belt-like section in a substantially central portion of said substantially elastic belt-like section for engagement against a predetermined portion of the body of a wearer in the vicinity of the lower back of the wearer;

a completely separable inelastic front panel having opposing end portions and dimensioned to overlie and bear against substantially the complete abdomen of a wearer; and contact-type connecting means including contact-type engagement areas at said opposing end portions of said inelastic front panel and at the free end portions of said substantially elastic belt-like section for continuously adjustably connecting each of said opposing end portions of said inelastic front panel to a respective free end portion of said substantially elastic belt-like section at a continuously variable plurality of positions relative to said free end portions with said end portions of said inelastic front panel always in overlying contact with their respective free end portion of said substantially elastic belt-like section to substantially prevent horizontal and vertical relative movement therebetween at the contact areas so that said inelastic front panel is substantially symmetrically locatable relative to said substantially elastic belt-like section at a plurality of orientations with said inelastic front panel overlying and elastically biased against substantially the complete abdominal area of the body of a wearer and so that said appliance is continuously adjustable to different sizes and different orientations of said front panel to accommodate growth of the abdominal area of a pregnant woman.

2. An appliance according to claim 1 wherein said belt-like section includes means forming a pocket therein for receiving said substantially rigid sheet-like member.

3. An appliance according to claim 2 wherein said means forming a pocket has an opening therein for removably receiving said substantially rigid sheet-like member therein.

4. An appliance according to claim 1 wherein said substantially rigid sheet-like member is heat deformable and is moldable, in the heated condition, to conform to the contours of the body portion of a wearer in the vicinity of the lower back of the wearer, and substantially retains its contour molded condition upon cooling.

5. An appliance according to claim 4 wherein said sheet-like member is a plastic member with a fabric layer on at least one surface thereof.

6. An appliance according to claim 5 wherein said sheet-like member has a fabric layer on both sides thereof.

7. An appliance according to claim 5 wherein said sheet-like member has a foam layer on one side thereof, said foam layer being directed toward the body of a wearer.

8. An appliance according to claim 1 wherein said elastic belt-like section has respective substantially inelastic end portions, said substantially inelastic end portions carrying at least a portion of said adjustable connecting means for adjustably connecting said front panel to said elastic belt-like section.

9. An appliance according to claim 8 wherein said adjustable connecting means comprises loop pile fasteners formed of interengageable male hook and female loop portions, one of said male and female portions being carried by said substantially non-elastic end members of said belt-like section and the other of said male and female sections being carried by said opposing end portions of said front panel.

10. An appliance according to claim 1 wherein said adjustable connecting means comprises loop pile fasteners formed of interengageable male hook and female loop portions, one of said male and female portions being carried by free end portions of said belt-like section and the other of said male and female sections being carried by said opposing end portions of said front panel.

11. An appliance according to claim 1 wherein said separable front panel is contoured generally in the shape of the abdomen of a pregnant woman.

12. An appliance according to claim 1 wherein said front panel comprises at least one substantially rigid stay member extending substantially transversely thereof.

* * * * *